US011028351B2

(12) United States Patent
Piorkowski et al.

(10) Patent No.: US 11,028,351 B2
(45) Date of Patent: Jun. 8, 2021

(54) UNIT DOSE DETERGENT PACKS WITH ANTI-YELLOWING AND ANTI-EFFLORESCENCE FORMULATIONS

(71) Applicant: Henkel IP & Holding GmbH, Duesseldorf (DE)

(72) Inventors: Daniel T. Piorkowski, Fairfield, CT (US); Casey Camire, Shelton, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 73 days.

(21) Appl. No.: 16/020,160

(22) Filed: Jun. 27, 2018

(65) Prior Publication Data

US 2020/0002655 A1 Jan. 2, 2020

(51) Int. Cl.

| | |
|---|---|
| ***C11D 3/30*** | (2006.01) |
| ***C11D 17/04*** | (2006.01) |
| ***C11D 1/835*** | (2006.01) |
| *C11D 1/72* | (2006.01) |
| *C11D 1/29* | (2006.01) |
| *C11D 1/22* | (2006.01) |

(52) U.S. Cl.

CPC ..... *C11D 17/042* (2013.01); *C11D 1/835* (2013.01); *C11D 3/30* (2013.01); *C11D 1/22* (2013.01); *C11D 1/29* (2013.01); *C11D 1/72* (2013.01)

(58) Field of Classification Search

CPC ..... C11D 17/042; C11D 3/30; C11D 1/835; C11D 1/72; C11D 1/29; C11D 1/22; C11D 3/044

See application file for complete search history.

(56) References Cited

U.S. PATENT DOCUMENTS

| | | | | |
|---|---|---|---|---|
| 5,952,283 | A | 9/1999 | Loffler et al. | |
| 6,037,319 | A | 3/2000 | Dickler et al. | |
| 6,949,498 | B2 * | 9/2005 | Murphy | C11D 1/02 510/327 |
| 7,259,134 | B2 | 8/2007 | Beckholt et al. | |
| 8,802,612 | B2 | 8/2014 | Wong et al. | |
| 2002/0016280 | A1 * | 2/2002 | Cropper | C11D 1/66 510/407 |
| 2002/0187909 | A1 * | 12/2002 | Gupta | C11D 3/3932 510/295 |
| 2003/0114332 | A1 | 6/2003 | Unilever | |
| 2003/0130154 | A1 * | 7/2003 | Van Der Hoeven | C11D 1/10 510/439 |
| 2005/0101505 | A1 | 5/2005 | Wood | |
| 2006/0094617 | A1 | 5/2006 | Price et al. | |

(Continued)

FOREIGN PATENT DOCUMENTS

| | | | |
|---|---|---|---|
| JP | 2002526639 | A | 8/2002 |
| WO | 2004003120 | A2 | 1/2004 |

(Continued)

*Primary Examiner* — Mark Kopec
*Assistant Examiner* — Jaison P Thomas
(74) *Attorney, Agent, or Firm* — Bojuan Deng

(57) ABSTRACT

A unit dose pack and methods for producing and using the same are provided. In accordance with one embodiment, a unit dose pack includes a container that includes a film. A wash composition is encapsulated within the container, where the wash composition includes an ionic detergent surfactant. The wash composition also includes a neutralizer that includes a metal hydroxide and triethanol amine.

8 Claims, 3 Drawing Sheets

(56) References Cited

U.S. PATENT DOCUMENTS

| | | | | |
|---|---|---|---|---|
| 2006/0166856 | A1 | 7/2006 | Petrat et al. | |
| 2011/0112005 | A1 | 5/2011 | Brooker et al. | |
| 2012/0135910 | A1 | 5/2012 | Gross et al. | |
| 2012/0175797 | A1 | 7/2012 | Regine et al. | |
| 2014/0274859 | A1 | 9/2014 | Adamy | |
| 2014/0329807 | A1 | 11/2014 | Xu et al. | |
| 2015/0031593 | A1 | 1/2015 | Meier et al. | |
| 2015/0057213 | A1* | 2/2015 | Hulskotter | C11D 3/38618 510/392 |
| 2015/0119312 | A1* | 4/2015 | Sanders | C11D 3/10 510/225 |
| 2015/0240187 | A1* | 8/2015 | Scheibel | C07C 309/62 510/498 |
| 2015/0252296 | A1* | 9/2015 | Roerdink Lander | C11D 1/825 510/218 |
| 2016/0040099 | A1 | 2/2016 | Maes et al. | |
| 2016/0090564 | A1* | 3/2016 | Loughnane | C11D 1/02 510/320 |
| 2016/0177222 | A1 | 6/2016 | Bianchetti et al. | |
| 2016/0376522 | A1 | 12/2016 | Bianchetti et al. | |
| 2018/0320110 | A1* | 11/2018 | Dotzauer | C11D 1/835 |
| 2019/0136162 | A1* | 5/2019 | Cooke | C11D 1/83 |
| 2019/0359915 | A1* | 11/2019 | Holland | C11D 1/90 |

FOREIGN PATENT DOCUMENTS

| | | | |
|---|---|---|---|
| WO | 2006050298 | A2 | 5/2006 |
| WO | 2016040629 | A1 | 3/2016 |
| WO | 2017151313 | A1 | 9/2017 |

* cited by examiner

UNIT DOSE DETERGENT PACKS WITH ANTI-YELLOWING AND ANTI-EFFLORESCENCE FORMULATIONS

TECHNICAL FIELD

The technical field relates to detergent packaged in unit dose packs and methods of producing and using the same, and more particularly relates to unit dose packs with reduced yellowing over time without efflorescence, and methods of producing and using the same.

BACKGROUND

Detergent in unit dose packs is available for a variety of washing activities, such as garment laundering and dish washing. The unit dose pack provides a pre-measured quantity of detergent that is easy to carry and convenient to use. The unit dose pack minimizes over-dosage of detergent and has proven popular with consumers.

Many unit dose packs include a wash composition that is encapsulated within a film, where the wash composition includes detergent, solvents, and other components useful for cleaning or other purposes. In many cases, the film is clear so the contents are visible. Some consumers interested in reduced environmental impact prefer a "free and clear" product, where the product is free of colorants and perfumes, so the product appears clear. However, some components of the wash composition tend to degrade and form colored bodies over time. For example, monoethanol amine may be utilized as a neutralizer to help control the pH of the wash composition, and monoethanol amine degradation products tend to have a yellow color that makes the entire wash composition appear yellow. Other components may also degrade to form colored bodies as well, or may have a color before degradation. This yellow color may be negatively perceived by some consumers.

Accordingly, it is desirable to provide a unit dose pack where the wash composition does not turn yellow, or at least acquires a yellow color at a slower rate and/or at lower color levels than traditional unit dose packs, including methods of producing using the same. In addition, it is desirable to provide unit dose packs with neutralizers that reduce yellowing while remaining compatible with the encapsulating film, and methods of producing and using the same. Furthermore, other desirable features and characteristics will become apparent from the subsequent detailed description and the appended claims, taken in conjunction with the accompanying drawings and the foregoing technical field and background.

BRIEF SUMMARY

A unit dose pack and methods for producing and using the same are provided. In accordance with one embodiment, a unit dose pack includes a container that includes a film. A wash composition is encapsulated within the container, where the wash composition includes an ionic detergent surfactant. The wash composition also includes a neutralizer that includes a metal hydroxide and triethanol amine.

A unit dose pack is provided in another embodiment. The unit dose pack includes a wash composition encapsulated within a film, where the film includes polyvinyl alcohol and is free of efflorescence solids. The wash composition includes an ionic detergent surfactant and a neutralizer, where the neutralizer includes a metal hydroxide and triethanol amine. The wash composition includes the ionic detergent surfactant at from about 12 to about 25 weight percent, the metal hydroxide at from about 0.2 to about 3.5 weight percent, and the triethanol amine at from about 1 to about 3 weight percent, all based on a total weight of the wash composition. A metal hydroxide/triethanol amine ratio is from about 3:1 to about 1:4.

In accordance with yet another embodiment a method or producing a unit dose pack includes forming a wash composition, where the wash composition includes (a) an ionic detergent surfactant, (b) water, and (c) a neutralizer. The neutralizer includes a metal hydroxide and triethanol amine. The wash composition is encapsulated in a container to form the unit dose pack, where the container includes a film.

BRIEF DESCRIPTION OF THE DRAWINGS

The present embodiments will hereinafter be described in conjunction with the following drawing figures, wherein like numerals denote like elements, and wherein.

DETAILED DESCRIPTION

The following detailed description is merely exemplary in nature and is not intended to limit the unit dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

A unit dose pack includes a blend of a metal hydroxide and triethanol amine as neutralizers, and this blend of neutralizers results in reduced formation of colored bodies during storage.

Figure 1:
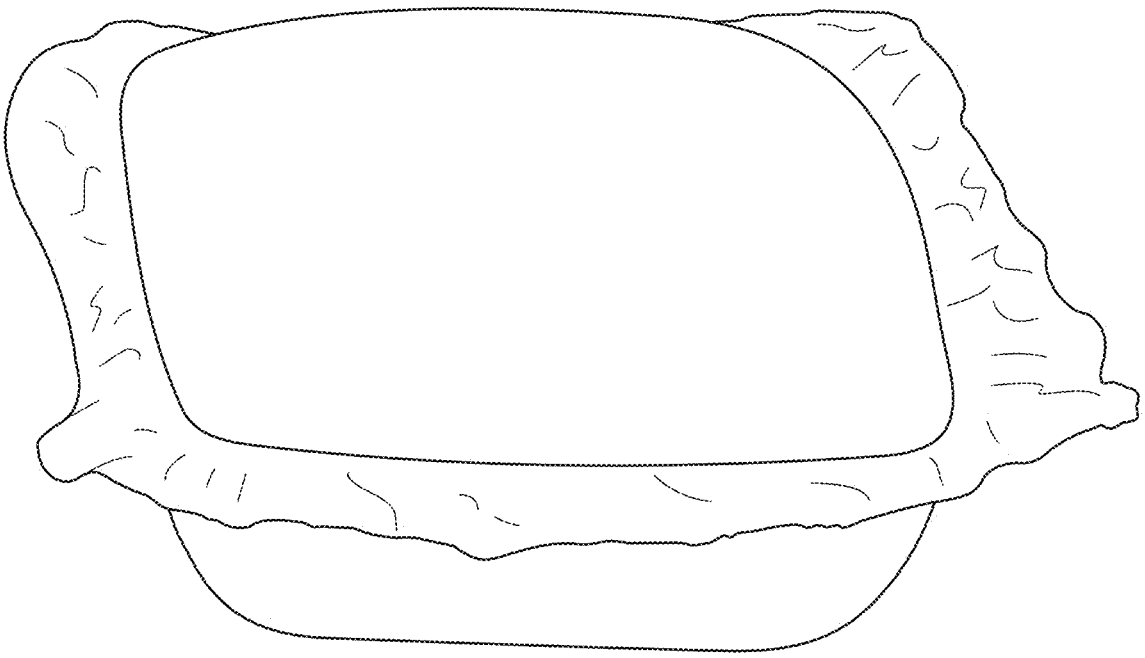
FIG. 1 is an exemplary unit dose pack.

Reference is made to exemplary embodiment illustrated in FIG. 1. A unit dose pack is formed by encapsulating a wash composition within a container, where the container includes a film. In some embodiments, the film forms one half or more of the container, where the container may also include dyes, print, or other components in some embodiments. The film is water soluble such that the film will completely dissolve when an exterior of the film is exposed to water, such as in a washing machine typically used for laundry. When the film dissolves, the container ruptures and the contents are released. As used herein, "water soluble" means at least 2 grams of the solute (the film in one example) will dissolve in 5 liters of water, for a solubility of at least 0.4 grams per liter (g/l), at a temperature of 25 degrees Celsius (° C.) unless otherwise specified. Suitable films for packaging are rapidly and completely soluble in water at temperatures of about 5° C. or greater.

The film is desirably strong, flexible, shock resistant, and non-tacky during storage at both high and low temperatures and high and low humidities. In an exemplary embodiment, the film is initially formed from polyvinyl acetate, and at least a portion of the acetate functional groups are hydrolyzed to produce alcohol groups. Therefore, the film includes polyvinyl alcohol (PVOH), and may include a higher concentration of PVOH than polyvinyl acetate. Such films are commercially available with various levels of hydrolysis, and thus various concentrations of PVOH. In an exemplary embodiment the film initially has about 85 percent of the acetate groups hydrolyzed to alcohol groups, but other percentages of hydrolysis are also possible in alternate embodiments. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 65 to about 90 μm in various embodiments. The film may include alternate materials in some embodiments, such as methyl hydroxy propyl cellulose and polyethylene oxide, but the film is water soluble in all embodiments.

The unit dose pack may be formed from a container having a single section, but the unit dose pack may be formed from containers with two or more different sections (not illustrated) in alternate embodiments. In embodiments with a container having two or more sections, the contents of the different sections may or may not be the same. In some embodiments, the unit dose pack is formulated and configured for cleaning laundry, but other cleaning purposes are also possible. The wash composition is positioned within the container, and the container is sealed to encapsulate and enclose the wash composition. The wash composition is typically in direct contact with the film of the container within the unit dose pack. The film of the container is sealable by heat, heat and water, ultrasonic methods, or other techniques, and one or more sealing techniques may be used to enclose the wash composition within the container.

In an exemplary embodiment, the wash composition is liquid when encapsulated within the container. The liquid wash composition may have a viscosity of from about 100 to about 1,000 centipoise, or from about 100 to about 300 centipoise in different embodiments, where "viscosity," as used herein, means the viscosity measured by a rotational viscometer at a temperature of 25 degrees Celsius (° C.,) using an LV02 cylindrical spindle at about 20 revolutions per minute (RPM) with a Brookfield® DV2T viscometer. The liquid form facilitates rapid delivery and dispersion of the wash composition once the container ruptures, and this rapid dispersion can aid cleaning. In some embodiments, the wash composition is flowable, such as a gel, a liquid with suspended particulates, or other forms.

In an exemplary embodiment, the unit dose pack is sized to provide a desired quantity of wash composition for one load of laundry or one batch of dishes in a dishwasher. The unit dose pack may also be sized for a fraction of a desired quantity, such as one half of a load of laundry, so a user can adjust the amount of detergent added without having to split a unit dose pack. In an exemplary embodiment, the unit dose pack has a weight of from about 5 to about 50 grams. In alternate embodiments, the unit dose pack is from about 10 to about 40 grams, or from about 20 to about 30 grams.

A plurality of components are combined to form the wash composition, where the wash composition is typically prepared prior to encapsulation within the container. A total weight of the wash composition does not include the weight of the film or the container, where the total weight of the wash composition is generally referenced herein as the basis for the weight percent of components of the wash composition. Unless otherwise specified, the concentration of all components described herein, other than the film, is the weight percent of the named component based on the total weight of the wash composition.

In an exemplary embodiment, the wash composition is free of dyes and pigments. Wash compositions that are free of dyes and pigments may be referred to as "free and clear," meaning the wash composition is free of dyes and pigments, and may be free of fragrance components. Some consumers prefer products that are free of dyes, pigments and/or fragrances, because such products are perceived as being more environmentally friendly. Some components that are not a dye or a pigment may have some color, where that component is primarily used for a purpose other than imparting color. In some embodiments, the component itself does not impart color, but a breakdown product or a by-product of that component does impart a visible color. For example, some neutralizers have breakdown products that impart color, where the neutralizer is primarily added to neutralize acids and thereby adjust the pH of the wash solution. In free and clear products, components that impart a color are generally undesirable.

A solvent is a component that is utilized as a carrier in a formulation, where other components (solutes) are dissolved in the solvent. Solvents generally solvate solutes and act as bulk fillers for the formula when used below a certain use-level so as to not plasticize the film. Specific criteria that precisely and exactly define what is or is not a solvent are difficult to define, because some components may have more than one purpose. Generally, solvents for liquid formulations are liquids at standard conditions (i.e., 1 atmosphere pressure and 20 degrees Celsius (° C.)). Typically, ionic detergent surfactants, nonionic detergent surfactants, optical brighteners, dyes or pigments, bleach activators or agents, enzymes, perfumes or other ingredients added for odor purposes, bittering agents, peroxy compounds, soil release agents, dye transfer inhibitors, foam inhibitors, chelators or other water softeners are not considered "solvents." The wash composition includes one or more solvents in an exemplary embodiment. For example, water may be present in the wash composition at a concentration of from about 2 to about 45 weight percent, or present in an amount of from about 5 to about 35 weight percent, or present in an amount of from about 8 to about 28 weight percent, or present in an amount of from about 10 to about 25 weight percent in various embodiments, based on the total weight of the wash composition. Other non-aqueous solvents that may be included in the wash composition include, but are not limited to, glycerol, propylene glycol, ethylene glycol, ethanol, and a 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids.

The wash composition includes other components as well. For example, the wash composition may include one or more ionic detergent surfactants, where the ionic detergent surfactant is formulated for laundry in an exemplary embodiment. The ionic detergent surfactant may include one or more surfactants, including cationic and/or anionic surfactants, in various embodiments. The ionic detergent surfactant may be present in the wash composition at a concentration of from about 5 to about 55 weight percent in one embodiment, but the ionic detergent surfactant may be present in the wash composition at a concentration of about 10 to about 35 weight percent or from about 12 to about 25 weight percent in alternate embodiments, based on a total weight of the wash composition.

Suitable ionic detergent surfactants that are anionic include soaps which contain sulfate or sulfonate groups, including those with alkali metal ions as cations. Usable soaps include alkali metal salts, amine salts, or other salts of saturated or unsaturated fatty acids with 12 to 18 carbon (C) atoms. Such fatty acids may also be used in incompletely neutralized form. Usable ionic detergent surfactants of the sulfate type include sulfuric acid semi esters of fatty alcohols with 12 to 18 C atoms, and/or alcohol ethoxysulfates, where these compounds may be present in a salt form. Usable ionic detergent surfactants of the sulfonate type include alkane sulfonates with 12 to 18 C atoms and olefin sulfonates with 12 to 18 C atoms, such as those that arise from the reaction of corresponding mono-olefins with sulfur trioxide. Another type of sulfonate surfactant includes alpha-sulfofatty acid esters such as those that arise from the sulfonation of fatty acid methyl or ethyl esters, and lauryl ether sulfates. In an exemplary embodiment, the wash composition is free of linear alkyl benzene sulfonic acid surfactants, such as linear alkylbenzene sulfonates with 9 to 14 C atoms in the alkyl moiety, but linear alkyl benzene sulfonic acid surfactants may be present in the wash composition in alternate embodiments. As used herein, "free of" means the named component is present in an amount of about 0.001 weight percent or less, based on a total weight of the named composition (such as the wash composition), unless otherwise specified. The linear alkyl benzene sulfonic acid surfactants tend to have some color, and the use of linear alkyl benzene sulfonic acids also tends to increase the total quantity of neutralizer required in the wash composition. The neutralizer tends to produce colored degradation products, or cause other undesired effects as described below, so elimination of the linear alkyl benzene sulfonic acids may help prevent or minimize undesirable yellowing.

Suitable ionic detergent surfactants that are cationic may include textile-softening substances of the general formula X, XI, or XII as illustrated below:

(X)

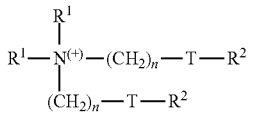

(XI)

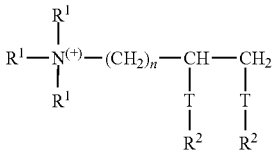

(XII)

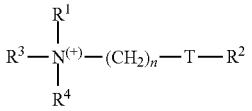

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3=R^1$ or $(CH_2)_n$-T-$R^2$; $R^4=R^1$ or $R^2$ or $(CH_2)_n$-T-$R^2$; T=—$CH_2$—, —O—CO—, or —CO—O—, and n is an integer from 0 to 5. The ionic detergent surfactants that are cationic may include conventional anions of a nature and number required for charge balancing. Alternatively, the ionic detergent surfactant may include anionic detergent surfactants that may function to balance the charges with the cationic detergent surfactants. In some embodiments, ionic detergent surfactants that are cations may include hydroxyalkyltrialkylammonium compounds, such as $C_{12-18}$ alkyl(hydroxyethyl)dimethyl ammonium compounds, and may include the halides thereof, such as chlorides or other halides. The ionic detergent surfactants that are cations may be especially useful for compositions intended for treating textiles.

Nonionic detergent surfactants may optionally be present in the wash composition at a concentration of from about 0 to about 60 weight percent, or from about 5 to about 50 weight percent, or from about 10 to about 40 weight percent, or from about 15 to about 30 weight percent in various embodiments, based on the total weight of the wash composition. Suitable nonionic detergent surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Several other components may optionally be added to and included in the wash composition, including but not limited to water-binding saccharides, enzymes, peroxy compounds, bleach activators, anti-redeposition agents, neutralizers, optical brighteners, foam inhibitors, chelators, buttering agents, dye transfer inhibitors, soil release agents, water softeners, and other components. A partial, non-exclusive list of additional components that may be added to and included in the wash composition include electrolytes, pH regulators, graying inhibitors, anti-crease components, dyes and/or pigments, scents, processing aids, antimicrobial agents, and preservatives.

Water binding saccharides are optionally included in the wash composition. In some embodiments, the saccharide is selected from the group consisting of fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof.

One example of a saccharide that may be utilized is HFCS. HFCS typically refers to a blend of approximately 23% water and 77% saccharide. For example, HFCS 55 typically refers to a blend of water (about 23%), glucose (about 34%), and fructose (about 42%). However, in a dried form, HFCS 55 contains approximately 55% fructose by weight of dry HFCS. Unless otherwise stated, HFCS used herein refers to a wet blend which contains water, as it is supplied from HFCS manufacturers. However, it should be understood that dry or essentially dry hybrids of monosaccharides (e.g. HFCS), wherein water has been removed partially or completely, can also be used. While pure fructose is very viscous and hard to handle, HFCS is more dilute and easier to handle. HFCS is also more cost-effective to manufacture. The United States Food and Drug Administration has even determined that HFCS is a safe ingredient for food and beverage manufacturing. It is certainly a safe and green ingredient for detergent products Foam inhibitors may optionally be included in the wash composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, coconut fatty acids are used as foam inhibitors, but other embodiments are possible, such as mixtures of paraffins and bistearylethylenediamide. The wash composition may include the foam inhibitor at an amount of from about 0 to about 15 weight percent, but in other embodiments the foam inhibitor may be present at an amount of from about 0.05 to about 10 weight percent, or an amount of from about 0.5 to about 8 weight percent, based on the total weight of the wash composition.

Neutralizers are added to and included in the wash composition. The neutralizer includes, but is not limited to, a metal hydroxide and triethanol amine. Exemplary metal hydroxides are sodium hydroxide and/or potassium hydroxide, and other possible neutralizers include, but are not limited to, monoethanol amine, binary amines, buffers, or other compounds that adjusts the pH of the wash composition. Neutralizers may be present in the wash composition at an amount of from about 0.1 to about 10 weight percent in some embodiments, based on the total weight of the wash composition, but in other embodiments the neutralizer may be present in the wash composition at an amount of from about 0.5 to about 5 weight percent, or an amount of from about 1 to about 3 weight percent, based on the total weight of the wash composition. The neutralizer may be utilized to adjust the pH of the wash composition to from about 6 to about 10, or from about 6.5 to about 9.5, or from about 7 to about 9 in various embodiments. The neutralizer may form a cation that combines with an anionic detergent surfactant and/or a coconut fatty acid or other foam inhibitor and/or another anionic component within the wash composition. In many cases, the neutralizer forms a salt with an anionic component. As such, the anionic detergent surfactant may be present in the wash composition as a surfactant salt, and the coconut fatty acid may be present in the wash composition as a coconut fatty acid salt. In some embodiments, the neutralizer is included in a slight excess relative to the anionic detergent surfactant or other acidic components to adjust the pH of the wash composition to within a desired range, such as the range(s) mentioned above.

Many film manufacturers caution against the use of sodium hydroxide in a wash composition because sodium hydroxide can cause efflorescence solids to form in the film. Efflorescence results when a component such as sodium hydroxide is carried into the film, where that component or a portion thereof precipitates within the film. The solubility of the efflorescence component may be different in the film than in the wash composition, but other reasons for the efflorescence may also be possible. In any event, efflorescence is undesirable because it causes a "cloudy", opaque, or otherwise unattractive appearance of the film. In an exemplary embodiment, the film is free of efflorescence solids, where being "free" of efflorescence solids is defined herein as having less than about 0.1 weight percent of visible particulates in the film, based on a total weight of the film. Sodium hydroxide is specifically mentioned in manufacturer recommendations, but other metal hydroxides are expected to produce similar results, such as potassium hydroxide.

As mentioned previously, some neutralizers have breakdown products that are colored, and this color is undesirable. For example, monoethanol amine is known to have colored breakdown products, and these breakdown products tend to form when the monoethanol amine is stored at temperatures of about 100 degrees Fahrenheit (° F.) (38 degrees Celsius (° C.)) or more for time periods of one day or more. However, other storage conditions may cause colored degradation products or by-products as well. Alternative amines may be used that are more resistant to the formation of breakdown products, such as a tertiary amine, but tertiary amines can also product breakdown products when stored at temperatures of about 110° F. (43° C.) or greater for time periods of about 5 days or more, and the colored products formed from triethanol amine (an exemplary tertiary amine) tend to be strongly colored. Other storage conditions may also result in colored products within triethanol amine or other tertiary amines. As such, conventional wisdom suggests that triethanol amine should not be used as the neutralizer because of the strongly colored breakdown products that can be formed, and a metal hydroxide should not be used as a neutralizer because of the efflorescence issues.

It has been unexpectedly discovered that the use of a mixture of triethanol amine and a metal hydroxide as the neutralizer significantly reduces the formation of colored bodies and does not create efflorescence solids, even after the unit dose pack is stored at elevated temperatures for extended periods of time. As such, in an exemplary embodiment the wash composition includes a neutralizer, where the neutralizer includes both a metal hydroxide and triethanol amine. The combination of two different materials that are each unacceptable when used alone produces a wash composition with superior resistance to the formation of colored bodies and to the formation of efflorescence solids during extended storage at elevated temperatures. The neutralizer is free of monoethanol amine in an exemplary embodiment, but monoethanol amine may be utilized in other embodiments.

The neutralizer may form ions, such as a metal hydroxide ion and/or a triethanol amine ion, and these ions may form salts with acidic or cationic compounds in the wash composition. For example, the surfactant salt described above may include one or more of the metal hydroxide ion and the triethanol amine ion. Another example is the coconut fatty acid salt, which also may include one or more of the metal hydroxide ion and the triethanol amine ion. Other acidic or anionic compounds in the wash composition may also form salts with one or more of the metal hydroxide ion and the triethanol amine ion. In general, references to a compound herein include that compound in acid form, base form, salt form, or ionic form.

In an exemplary embodiment, the neutralizer has a metal hydroxide/triethanol amine ratio that is a ratio of a total weight of metal hydroxide within the wash composition divided by a total weight of triethanol amine within the wash composition. The metal hydroxide/triethanol amine ratio is based on the 100% weight of the metal hydroxide 50 and the 100% weight of the triethanol amine. As such, ten grams of a 50% solution of sodium hydroxide includes five grams of sodium hydroxide and five grams of other materials (typically water). Ten grams of an 85% solution of triethanol amine includes 8.5 grams of triethanol amine and 1.5 grams of other materials. In exemplary embodiments the metal hydroxide/triethanol amine ratio is from about 9:1 to about 1:9, or from about 5:1 to about 1:5, or from about 3:1 to about 1:4. The metal hydroxide is selected from the group of sodium hydroxide, potassium hydroxide, and a combination thereof in an exemplary embodiment. In exemplary embodiments, the metal hydroxide is present in the wash composition at a concentration of from about 0.1 to about 5 weight percent, or from about 0.1 to about 4 weight percent, or from about 0.2 to about 3.5 weight percent, based on the total weight of the wash composition. The triethanol amine is present in the wash composition at from about 0.25 to about 4 weight percent in an exemplary embodiment, but in alternate embodiments the triethanol amine is present at from about 0.5 to about 2 weight percent, or from about 1 to about 3 weight percent, based on the total weight of the wash composition.

The wash composition optionally includes other components in various embodiments. Typically, the wash composition will include several different components in varying amounts. Some of the optional additional components are further described below.

Possible enzymes that may be in the wash composition contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected wash composition, (i.e., pH-optimum, compatibility with other enzymatic and non-enzymatic ingredients, etc.). The detergent enzyme(s) may be included in the wash composition by adding separate additives containing one or more enzymes, or by adding a combined additive comprising all the enzymes that are added to the wash composition. The enzyme(s) should be present in the wash composition in effective amounts, such as from about 0 weight percent to about 5 weight percent of enzyme, or from about 0.001 to about 5 weight percent, or from about 0.2 to about 3 weight percent, or from about 0.5 to about 3 weight percent, based on the total weight of the wash composition, in various embodiments.

As alluded to above, a peroxy compound may optionally be present in the wash composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition at an amount of from about 0 to about 50 weight percent, or an amount of from about 3 to about 30 weight percent, or an amount of from about 3 to about 10 weight percent, based on the total weight of the wash composition, in various embodiments.

Bleach activators may optionally be added and included in the wash composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition, in a known manner. As such, the bleach activator and/or other components may be present in a liquid wash composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternate embodiments, the peroxy compounds and bleach activators, if present, may be within separate chambers of the container to prevent premature interactions. In various embodiments, the bleach activators may be present in the wash composition in quantities of from about 0 to about 8 weight percent, or from about 0 to about 6 weight percent, or from about 0 to about 4 weight percent, in each case relative to the total weight of the wash composition.

One or more anti-redeposition agents may also be optionally included in the wash composition. Anti-redeposition agents include polymers with a soil detachment capacity, which are also known as "soil repellents" due to their ability to provide a soil-repelling finish on the treated surface, such as a fiber. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol $HO—(CHR^{11}—)_aOH$, which may also be present as a polymeric diol $H—(O—(CHR^{11}—)_a)_bOH$. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units $—O—(CHR^{11}—)_aO—$ but also polymer diol units $—(O—(CHR^{11}—)_a)_bO—$. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The number average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—$(CHR^{11}—)_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with a number average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, and benzoic acid. These end groups may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, hydrogenation products thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition at an amount of from about 0 to about 5 weight percent, or an amount of from about 0 to about 4 weight percent, or an amount of from about 0 to about 3 weight percent, based on the total weight of the wash composition, in various embodiments.

Optical brighteners may optionally be included in the wash composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners may also be used. Optical brighteners may be present in the wash composition at an amount of from about 0 to about 5 weight percent in some embodiments, but in other embodiments optical brighteners are present in an amount of from about 0.005 to about 5 weight percent, or an amount of from about 0.01 to about 0.5 weight percent, or an amount of from about 0.05 to about 0.3 weight percent, based on the total weight of the wash composition.

Chelators bind and remove calcium, magnesium, or other metals from water, and may optionally be included in the wash composition. Chelators are sometimes referred to as water softeners. Many compounds can be used as chelators, including but not limited to ethylenediaminetetraacetic acid (EDTA), nitrilotriacetic acid, diethylenetriaminepenta (methylenephosphonic acid), nitrilotris(methylenephosphonic acid), 1-hydroxyethane-1,1-diphosphonic acid, iminodisuccinic acid (IDS), or other chelating agents. Chelators may be present in the wash composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the wash composition.

Bittering agents may optionally be added to hinder accidental ingestion of the unit dose pack or the wash composition. Bittering agents are compositions that taste bad, so children or others are discouraged from accidental ingestion. Exemplary bittering agents include denatonium benzoate, aloin, and others. Bittering agents may be present in the wash composition at an amount of from about 0 to about 1 weight percent, or an amount of from about 0 to about 0.5 weight percent, or an amount of from about 0 to about 0.1 weight percent in various embodiments, based on the total weight of the wash composition.

The wash composition may be prepared by combining and mixing the components of the wash composition with a mixer. Once mixed, the wash composition is encapsulated in the container, as described above. The components of the wash composition may all be mixed at one time, or different components may be pre-mixed and then combined. A wide variety of mixers may be used in alternate embodiments, such as an agitator, an in-line mixer, a ribbon blender, an emulsifier, and others. The wash composition is placed in a container, and then the film of the container is sealed with a sealer, where the sealer may utilize heat, water, ultrasonic techniques, water and heat, pressure, or other techniques for sealing the container and forming the unit dose pack.

Another exemplary embodiment contemplated herein is directed to the use of a unit dose pack as described above in a cleaning process, such as laundry and/or hard surface cleaning. In particular, an embodiment is directed to the use of a unit dose pack in laundering of textile and fabrics, such as house hold laundry washing and industrial laundry washing. A further exemplary embodiment is directed to the use of a unit dose pack in hard surface cleaning such as automated dish washing (ADW), car washing, and the cleaning of industrial surfaces.

The fabrics and/or garments subjected to a washing, cleaning or textile care process contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based, such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the unit dose pack is also added to the washing machine before wash water is added. In an alternate embodiment, the unit dose pack may be added to an automatic detergent addition system of a washing machine, where the contents of the unit dose pack are added to the wash water with the fabrics and/or garments after the washing process has begun. In yet another embodiment, the unit dose pack is manually added to the fabrics and/or garments with the wash water after the washing process has started. The film dissolves and releases the wash composition into the aqueous wash water. The film is dissolved and washes out of the washing machine with the excess wash water, so there is nothing to collect from the fabrics and/or garments after the wash cycle. The fabrics and/or garments are laundered with the wash water and the contents of the unit dose pack. The fabrics and/or garments may then be dried and processed as normal.

In an alternate embodiment, the unit dose pack is added to a detergent charging system for an automatic dish washing machine. The detergent charging system opens and releases the unit dose pack to the wash water and a main compartment of the dish washing machine at a designated point in the wash cycle.

EXAMPLES

Figure 2:
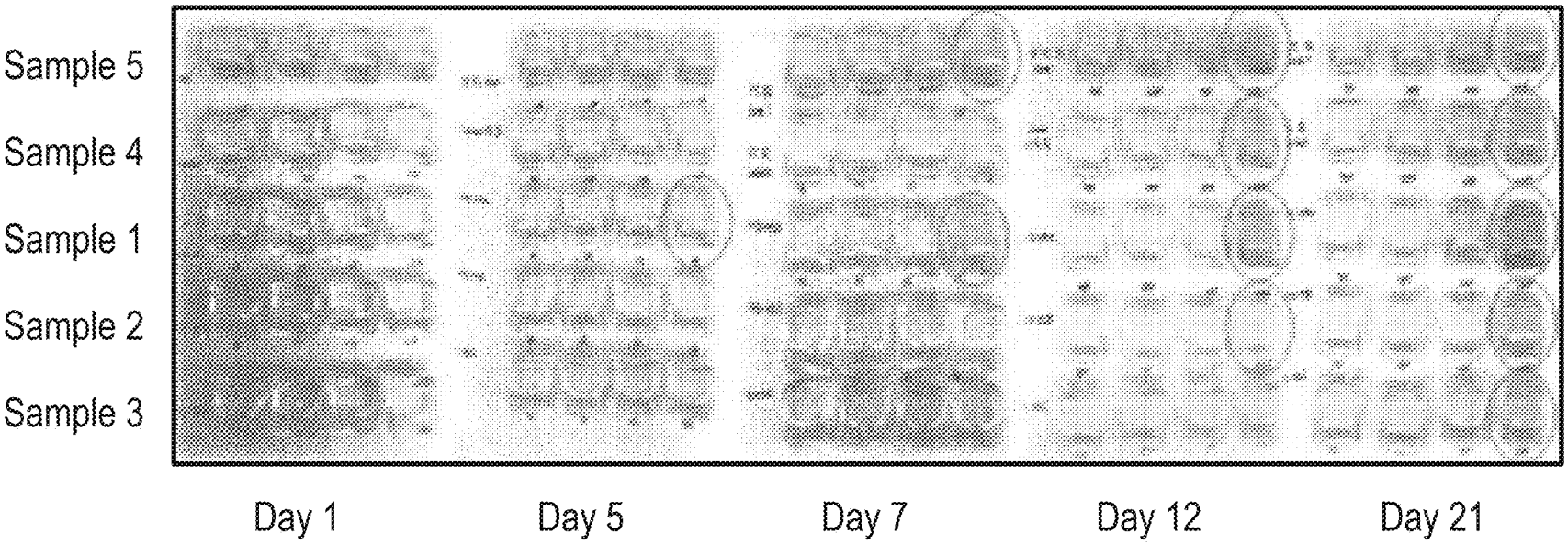
FIG. 2 is a photograph of test unit dose packs showing the color changes and efflorescence effects over time at tested conditions.

Unit dose packs were prepared using different neutralizers, and the unit dose packs were tested for adsorption in the ultraviolet/visible (UV/vis) spectrum. Higher values indicate higher adsorption, and higher adsorption indicates more color. Therefore, lower values were considered more appealing to consumers as free and clear products. Compositional data for eight different samples is provided, and test results for five different samples is also provided. Unit dose packs of each of the samples were stored at different temperatures for a period of up to thirty five days for testing, and the samples were tested by ultraviolet/visible (UV/vis) spectroscopy for adsorption at several time intervals during the storage period. FIG. 2 show test results in a visual format. The neutralizer for Sample 2 included both a metal hydroxide (sodium hydroxide) and triethanolamine. All samples experienced some yellowing, but Sample 2 with a mixture of sodium hydroxide and triethanol amine as neutralizers had the lowest degree of yellowing. Table 1 below lists eight samples and the compositions of each, where yellowing test results are available for Samples 1-5.

TABLE 1

| Component | % activity | Sample 1 6% CFA, TEA | Sample 2 4% CFA, blend | Sample 3 4% CFA, MEA | Sample 4 Control | Sample 5 Control | Sample 6 4% CFA, TEA | Sample 7* 4% CFA, blend | Sample 8 4% CFA, NaOH |
|---|---|---|---|---|---|---|---|---|---|
| C12-15 alcohol ethoxylate | 99.85 | 23.1 | 23.1 | 23.1 | 25.0 | 20.5 | 23.3 | 23.3 | 23.3 |
| Propylene glycol, 400 mw | 99.9 | 8.0 | 8.0 | 8.0 | 6.3 | 15.2 | 7 | 7.3 | 7.5 |
| Zeolite water | 100 | 10.0 | 10.0 | 10.0 | 4.6 | 2.8 | 12.6 | 12.6 | 12.6 |
| Optical brightener | 100 | 0.2 | 0.2 | 0.2 | 0.2 | 0.2 | 0.3 | 0.3 | 0.3 |
| Glycerin | 99.85 | 9.2 | 9.2 | 9.3 | 13.9 | 8.0 | 7.0 | 7.3 | 7.8 |
| Polyethylene glycol | 100 | 13.9 | 17.7 | 18.9 | 0 | 0 | 15.0 | 15.0 | 15.0 |
| Bittering agent | 25 | 0.05 | 0.05 | 0.05 | 0.05 | 0.05 | 0.05 | 0.05 | 0.05 |
| Alcohol ether sulfate | 60 | 23.2 | 22.5 | 22.2 | 26.0 | 14.2 | 23.0 | 23.0 | 23.0 |
| NaOH | 50 | 0 | 0.55 | 0 | 0 | 0 | 0 | 0.55 | 1.1 |
| Monoethanol amine | 99 | 0 | 0 | 0.8 | 3.2 | 6.4 | 0 | 0 | 0 |
| Triethanol amine | 85 | 2.85 | 1.25 | 0 | 0 | 0 | 2.4 | 1.3 | 0 |
| Linear alkyl benzene sulfonic acid | 95 | 0 | 0 | 0 | 5.0 | 18.4 | 0 | 0 | 0 |
| Coconut fatty acids | 100 | 6.0 | 4.0 | 4.0 | 10.0 | 10.0 | 4.0 | 4.0 | 4.0 |
| Polymer, polyethoxylated polyethyleneimine | 80 | 2.0 | 2.0 | 2.0 | 2.0 | 1.9 | 2.0 | 2.0 | 2.0 |

TABLE 1-continued

| Component | % activity | Sample 1 6% CFA, TEA | Sample 2 4% CFA, blend | Sample 3 4% CFA, MEA | Sample 4 Control | Sample 5 Control | Sample 6 4% CFA, TEA | Sample 7* 4% CFA, blend | Sample 8 4% CFA, NaOH |
|---|---|---|---|---|---|---|---|---|---|
| Sodium sulfite | 15 | 0 | 0 | 0 | 1.3 | 0 | 0 | 0 | 0 |
| enzyme | 100 | 1.5 | 1.5 | 1.5 | 2.5 | 2.5 | 2.6 | 2.6 | 2.6 |
| Tetrasodium iminodisuccinate | 33 | — | — | — | — | — | 0.9 | 0.9 | 0.9 |

*No efflorescence detected.

1. All compositions are listed as weight percent, based on a total weight of the wash composition.
2. All samples were packages in polyvinyl alcohol film containers.

Different unit dose packs for each sample were stored at temperatures of (i) 75 degrees Fahrenheit (° F.) (24 degrees Celsius (° C.)); (ii) 105° F. (41° C.); (iii) 113° F. (45° C.); and (iv) 125° F. (52° C.). Each unit dose pack at each storage temperature was tested for absorbance at a starting frequency of 700 nanometers (nm) and an ending frequency of 200 nm. The absorbance for the different samples is listed in Table 2 below, where images of the different test unit dose packs at different stages are illustrated in FIG. 2, as mentioned above. The columns for each day represented in FIG. 2 indicate a different storage temperature, where (i) the first column was stored at 75° F. (24° C.); (ii) the second column was stored at 105° F. (41° C.); (iii) the third column was stored at 113° F. (45° C.); and (iv) the fourth column was stored at 125° F. (52° C.).

TABLE 2

| Sample number | Temp | Day 0 Abs.* | Day 2 Abs.* | Day 5 Abs.* | Day 7 Abs.* | Day 12 Abs.* | Day 15 Abs.* | Day 23 Abs.* | Day 28 Abs.* | Day 35 Abs.* |
|---|---|---|---|---|---|---|---|---|---|---|
| 1 | 24° C. | 5 | 5 | 5 | 4 | 5 | 5 | 5 | 5 | 4 |
| 1 | 41° C. | 5 | 5 | 5 | 6 | 6 | 6 | 8 | 10 | 17 |
| 1 | 45° C. | 5 | 5 | 6 | 6 | 8 | 12 | 35 | 51 | 67 |
| 1 | 52° C. | 5 | 6 | 14 | 25 | 48 | 62 | 108 | — | — |
| 2 | 24° C. | 5 | 5 | 5 | 5 | 5 | 5 | 5 | 5 | 4 |
| 2 | 41° C. | 5 | 5 | 5 | 5 | 5 | 5 | 5 | 6 | 6 |
| 2 | 45° C. | 5 | 5 | 5 | 5 | 5 | 6 | 6 | 7 | 13 |
| 2 | 52° C. | 5 | 6 | 6 | 7 | 11 | 19 | 38 | — | — |
| 3 | 24° C. | 10 | 11 | 12 | 12 | 14 | 14 | 15 | 15 | 30 |
| 3 | 41° C. | 10 | 14 | 16 | 16 | 18 | 19 | 23 | 25 | 40 |
| 3 | 45° C. | 10 | 15 | 16 | 18 | 21 | 23 | 29 | 33 | 88 |
| 3 | 52° C. | 10 | 16 | 20 | 22 | 31 | 36 | 53 | — | — |
| 4 | 24° C. | 6 | 6 | 6 | 7 | 7 | 7 | 8 | 8 | 8 |
| 4 | 41° C. | 6 | 8 | 9 | 9 | 11 | 14 | 36 | 49 | 55 |
| 4 | 45° C. | 6 | 8 | 9 | 10 | 16 | 32 | 48 | 52 | 71 |
| 4 | 52° C. | 6 | 8 | 11 | 15 | 47 | 50 | 76 | — | — |
| 5 | 24° C. | 22 | 23 | 24 | 25 | 26 | 27 | 29 | 31 | 32 |
| 5 | 41° C. | 22 | 27 | 31 | 34 | 39 | 41 | 48 | 55 | 88 |
| 5 | 45° C. | 22 | 28 | 36 | 39 | 47 | 49 | 79 | 87 | 97 |
| 5 | 52° C. | 22 | 32 | 45 | 55 | 78 | 84 | 100 | — | — |

*The reported absorbance (Abs.) values are an integration of the absorption plot from about 400 nm to about 500 nm.

Sample 2 includes a mixture of sodium hydroxide and triethanol amine as the neutralizer, as indicated in Table 1. Samples 6, 7, and 8 where produced and no efflorescence was detected in Samples 6 or 7, but efflorescence was detected in Sample 8 (with sodium hydroxide and no triethanol amine.) However, Samples 6, 7, and 8 were not tested by UV/vis spectroscopy for yellowing over time. As can be seen from the test data reproduced above and as illustrated in FIG. 2, the lowest absorbance values were for Sample 2, which had a mixture of sodium hydroxide and triethanol amine as the neutralizer. This is most evident when the test results at the highest storage temperature are reviewed. For example, the test results on day 23 for Sample 2 stored at 52° C. was 38. Samples 1, 3, 4, and 5, on the 23$^{rd}$ day at a storage temperature of 52° C. had absorbance values of 108, 53, 76, and 100, respectively. No efflorescence solids were seen in Sample 2 during the course of the testing. These results show the improved performance achieved when a mixture of sodium hydroxide and triethanol amine are utilized for the neutralizer.

Alternate results from independent testing are also available and provided below. Two samples, Samples A and B, were prepared and testing for yellowing over time. The composition of Samples A and B are presented below in Table 3.

TABLE 3

| Description | % activity | Sample A Control, w/MEA | Sample B w/blend |
|---|---|---|---|
| C12-15 alcohol ethoxylate | 99.85 | 20 | 20 |
| Propylene glycol | 99.9 | 18 | 8.2 |
| Zeolite water | 100 | 5 | 11.9 |
| Optical brightener | 100 | 0.2 | 0.25 |

TABLE 3-continued

| Description | % activity | Sample A Control, w/MEA | Sample B w/blend |
|---|---|---|---|
| Glycerin | 99.85 | 5 | 5 |
| Bittering agent | 25 | 0.04 | 0.04 |
| Alcohol ether sulfate | 60 | 26.3 | 26.3 |
| NaOH | 50 | — | 4.4 |
| Monoethanol amine | 99 | 3.6 | — |
| Triethanol amine | 85 | — | 1.5 |
| Linear alkyl benzene sulfonic acid | 95 | 13.4 | 13.4 |
| Coconut fatty acids | 100 | 4 | 4 |
| Polymer, polyethoxylated polyethyleneimine | 80 | 2 | 2.5 |
| enzyme | 100 | 2.5 | 2.5 |
| Total water | | 13 | 22.5 |

Figure 3:
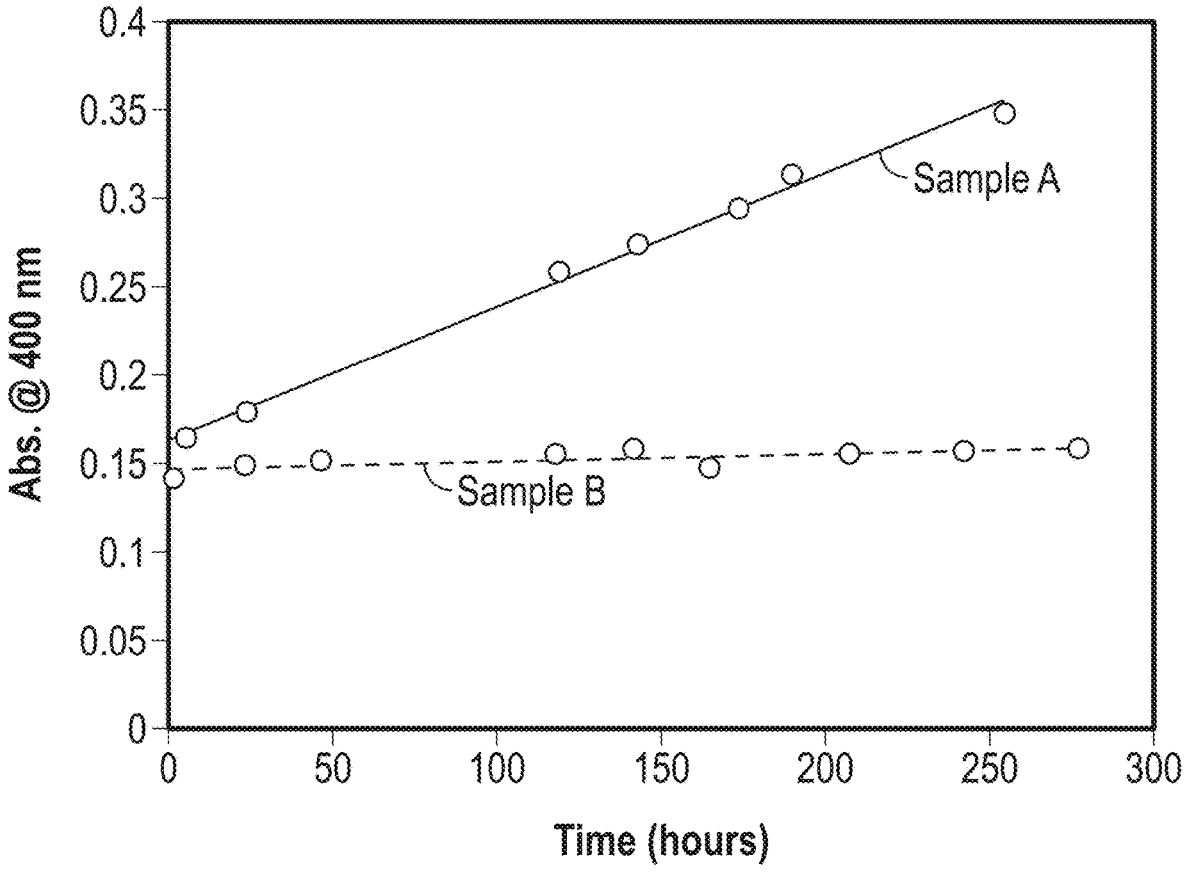
FIG. 3 is a graph of experimental results.

Samples A and B were tested for yellowing over time, and the results are listed in Table 4, below. No efflorescence solids were detected in the films of either sample. FIG. 3 illustrates the data from Table 4 in chart format. As can be seen, Sample B shows significantly less absorbance at 400 nanometers, indicating less yellowing. Blue light is absorbed at 400 nanometers, so the absorbance of blue light correlates to how much yellow light is emitted.

TABLE 4

| Testing time Hours | Sample A, Control w/MEA Abs. @ 400 nm | Sample B, with blend Abs. @ 400 nm |
|---|---|---|
| 0.5 | 0.17 | 0.15 |
| 3.5 | 0.17 | |
| 6 | 0.17 | |
| 22 | | 0.15 |
| 23 | 0.18 | |
| 45 | | 0.15 |
| 117 | | 0.16 |
| 119 | 0.26 | |
| 141 | | 0.16 |
| 143 | 0.28 | |
| 165 | | 0.15 |
| 174 | 0.30 | |
| 191 | 0.31 | |
| 207 | | 0.16 |
| 243 | | 0.16 |
| 256 | 0.35 | |
| 274 | | 0.16 |

1. All samples maintained at 75° F. (24° C.) during the testing. The samples were run simultaneously, but read a different times over the course of the testing periods.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose pack comprising:

a container, wherein the container comprises a film, and wherein the film is water soluble;

a wash composition encapsulated within the container; wherein:

the wash composition comprises:

a C12-C15 alcohol ethoxylate in an amount of about 23.1 weight percent;

propylene glycol in an amount of about 8 weigh percent;

an optical brightener in an amount of about 0.2 weight percent;

glycerin in an amount of about 9.2 weight percent;

polyethylene glycol in an amount of about 17.7 weight percent;

a bittering agent in an amount of about 0.013 weight percent;

alcohol ether sulfate in an amount of about 13.5 weight percent;

sodium hydroxide in an amount of about 0.28 weight percent;

triethanol amine in amount of about 1.06 weight percent;

coconut fatty acids in an amount of about 4 weight percent;

polyethoxylated polyethyleneimine in an amount of about 1.6 weight percent;

an enzyme in an amount of about 1.5 weight percent; and water, where all weight percents are based on the total weight of the wash composition.

2. The unit dose pack of claim 1 wherein the water is present in the wash composition in an amount of from about 5 to about 35 weight percent, based on the total weight of the wash composition.

3. The unit dose pack of claim 1 wherein the water is present in the wash composition in an amount of from about 10 to about 25 weight percent, based on the total weight of the wash composition.

4. The unit dose pack of claim 1 wherein the wash composition is free of a dye or pigment.

5. The unit dose pack of claim 1 wherein the wash composition is free of a linear alkyl benzene sulfonic acid.

6. The unit dose pack of claim 1 wherein the wash composition has a pH of from about 6 to about 10.

7. The unit dose pack of claim 1, wherein the film comprises polyvinyl alcohol.

8. The unit dose pack of claim 7, wherein the film is free of efflorescence solids.

* * * * *